US012545462B2

(12) United States Patent
Cheng

(10) Patent No.: US 12,545,462 B2
(45) Date of Patent: Feb. 10, 2026

(54) PACKAGING MACHINE STRUCTURE FOR WET PAPER TOWEL WITH STERILIZATING ABILITY

(71) Applicant: LE LONG MODERN CO., LTD., Puxin Township, Changhua County (TW)

(72) Inventor: Chi-Chang Cheng, Puxin Township, Changhua County (TW)

(73) Assignee: LE LONG MODERN CO., LTD., Changhua County (TW)

( * ) Notice: Subject to any disclaimer, the term of this patent is extended or adjusted under 35 U.S.C. 154(b) by 0 days.

(21) Appl. No.: 18/907,530

(22) Filed: Oct. 6, 2024

(65) Prior Publication Data

US 2025/0162754 A1 May 22, 2025

(30) Foreign Application Priority Data

Nov. 16, 2023 (TW) ..... 112212448

(51) Int. Cl.
*B65B 55/16* (2006.01)

(52) U.S. Cl.
CPC ..... *B65B 55/16* (2013.01)

(58) Field of Classification Search
None
See application file for complete search history.

(56) References Cited

FOREIGN PATENT DOCUMENTS

CN 108341092 A * 7/2018 ..... B65B 55/16
CN 113815933 A * 12/2021 ..... B65H 35/04

* cited by examiner

*Primary Examiner* — Tanzim Imam

(57) ABSTRACT

A packaging machine structure for wet paper towels having a sterilizing functionality has at least one rolling unit, a cutting unit attached behind the rolling unit, and a packing unit attached behind the cutting unit; a plurality of wet paper towels passing through the rolling unit, the cutting unit, and the packing unit to become a plurality of wet paper towel packs; wherein at least one germicidal lamp is disposed between the rolling unit and the cutting unit to sterilize the wet paper towels.

3 Claims, 6 Drawing Sheets

PACKAGING MACHINE STRUCTURE FOR WET PAPER TOWEL WITH STERILIZATING ABILITY

BACKGROUND OF THE INVENTION

Field of Invention

The present invention relates to a packaging machine structure for wet paper towel, and more particularly to a packaging machine structure for wet paper towel with sterilization ability.

Description of the Related Art

The convenience and wide range of uses of the wet paper towels make many people enjoy using it, and not only use them at home, but also when dining out with a single-piece package of the wet paper towel to wipe their hands instead of washing their hands. However, the wet paper towel without going through the sterilization process may cause the following problems:

1. Bacterial and virus contamination: Unsterilized wet paper towel may contain various bacteria, viruses and other microorganisms. These microorganisms can be transferred to the skin or objects during use, which may cause infection or spread diseases.
2. Skin sensitivity: Some people may be sensitive to microorganisms or microbial metabolites. Unsterilized wet paper towel may cause skin sensitivity reactions, such as redness, itching or rash.
3. Poor quality: The wet paper towel that has not been sterilized is more susceptible to microbial contamination during storage and use, which may lead to reduced product quality, such as deterioration, odor or discoloration.
4. Environmental issues: Unsterilized wet paper towel may require more additives and preservatives during production and use to prevent microbial contamination, which may have adverse effects on the environment.

Therefore, it is desirable to provide a packaging machine structure for wet paper towel with sterilization ability to mitigate and/or obviate the aforementioned problems.

SUMMARY OF THE INVENTION

An objective of present invention is to a packaging machine structure for wet paper towel with sterilization ability, which is capable of improving the above-mention problems.

In order to achieve the above-mentioned objective, a packaging machine structure for wet paper towel with sterilization ability has at least one rolling unit, a cutting unit attached behind the rolling unit, and a packing unit attached behind the cutting unit; a plurality of wet paper towels passing through the rolling unit, the cutting unit, and the packing unit to become a plurality of wet paper towel packs; wherein at least one germicidal lamp is disposed between the rolling unit and the cutting unit to sterilize the wet paper towels.

Other objects, advantages, and novel features of invention will become more apparent from the following detailed description when taken in conjunction with the accompanying drawings.

DETAILED DESCRIPTION OF PREFERRED EMBODIMENT

Figure 1:
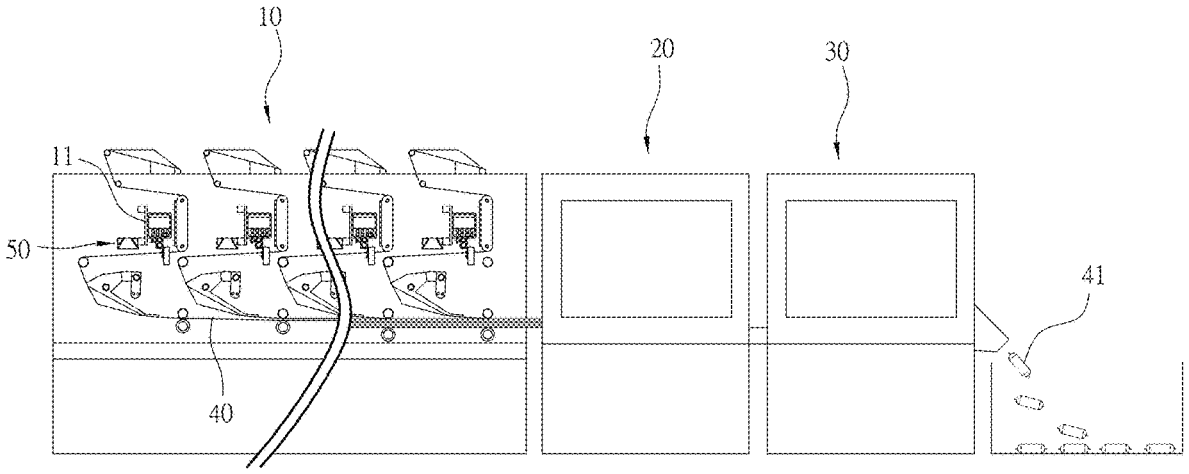
FIG. 1 is a schematic drawing of the packaging machine according to a preferred embodiment of the present invention.
Figure 2:
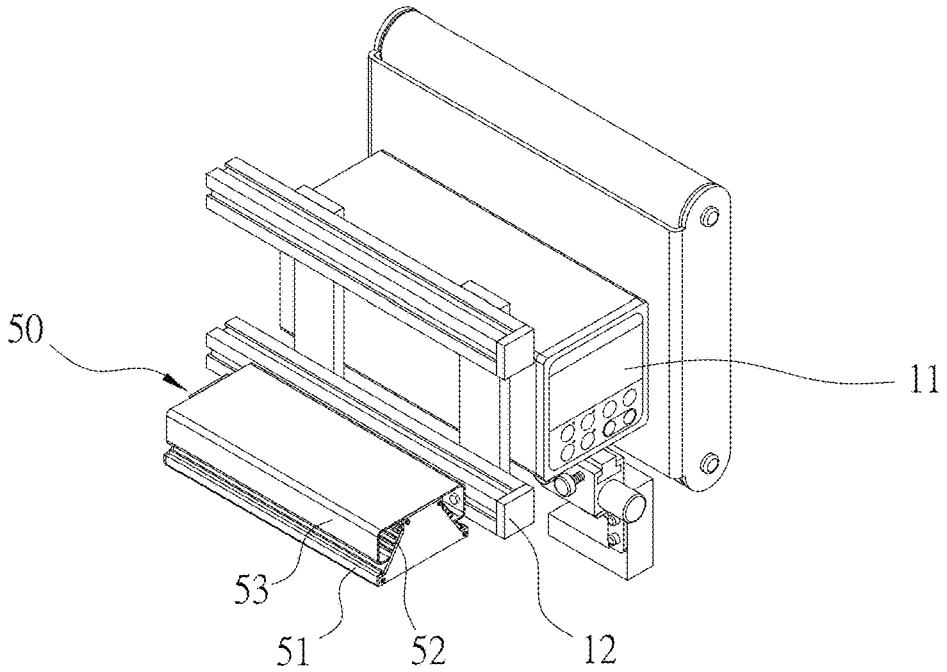
FIG. 2 is a schematic drawing of the correction machine equipped with a sterilizing lamp according to the preferred embodiment of the present invention.
Figure 3:
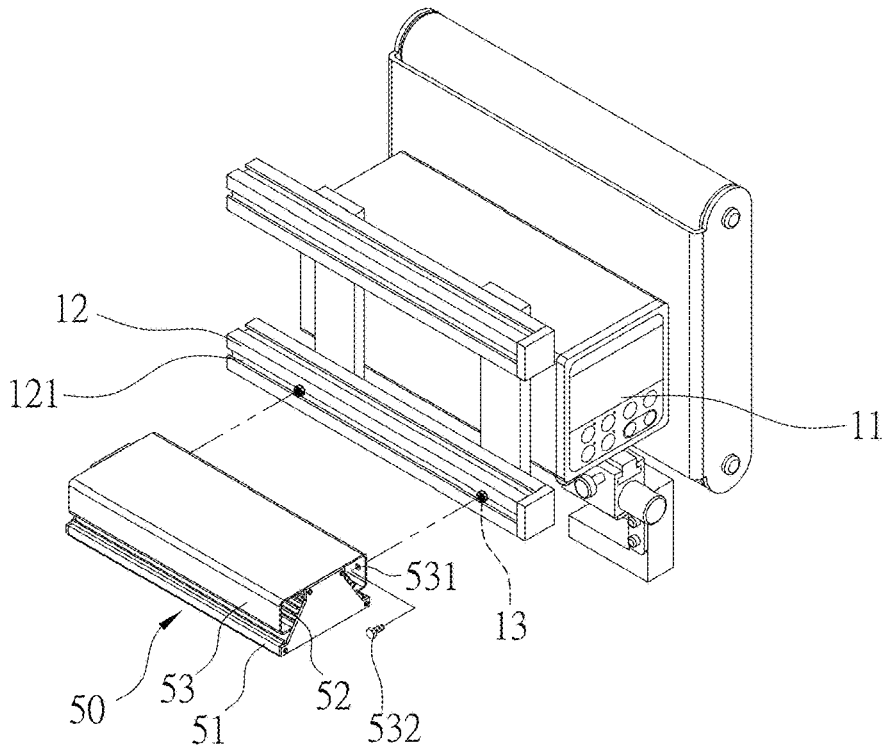
FIG. 3 is an exploded view of the correction machine and sterilizing lamp according to the preferred embodiment of the present invention.
Figure 4:
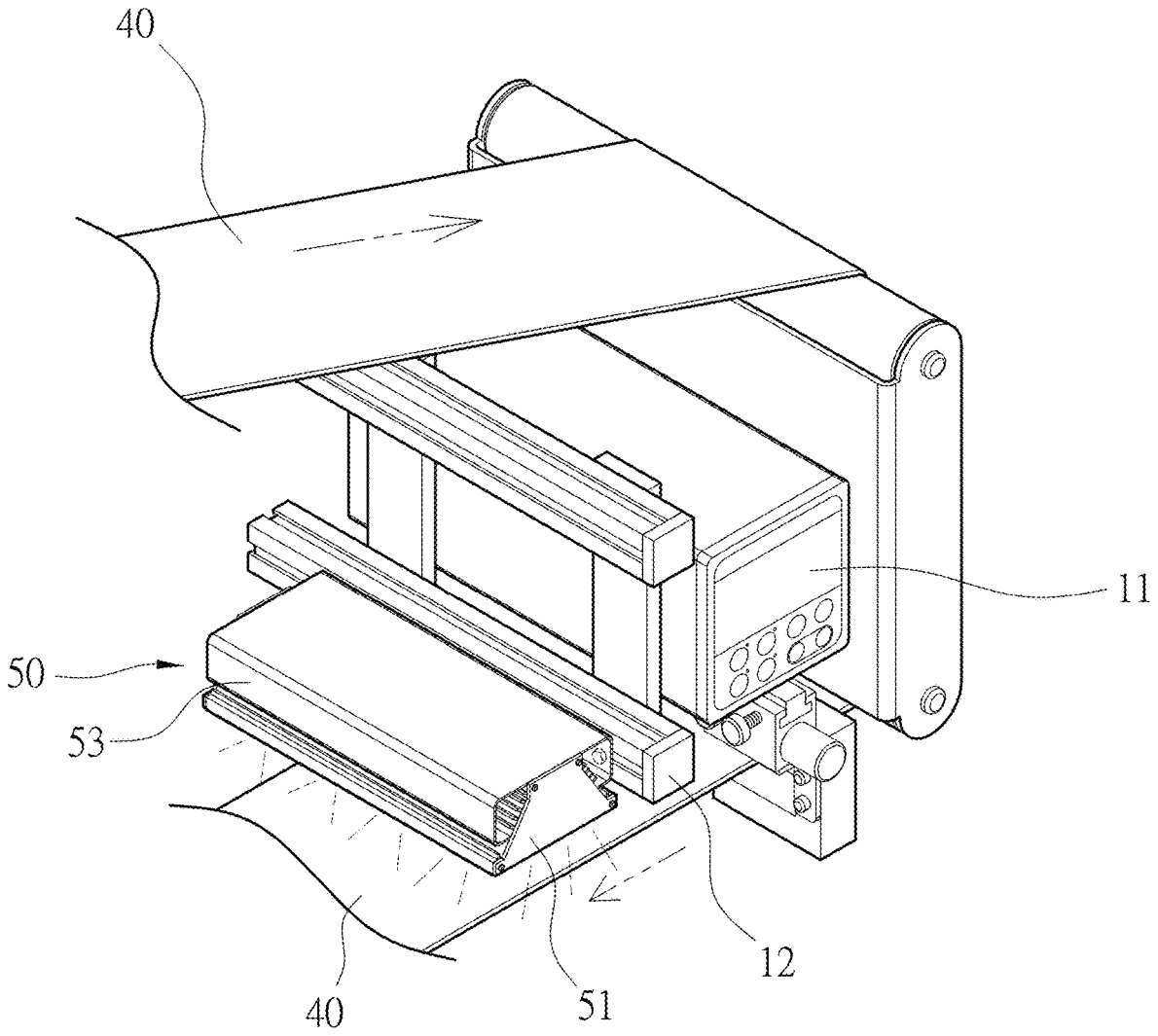
FIG. 4 is a three-dimensional view of the paper towel roll being sterilized according to the preferred embodiment of the present invention.
Figure 5:
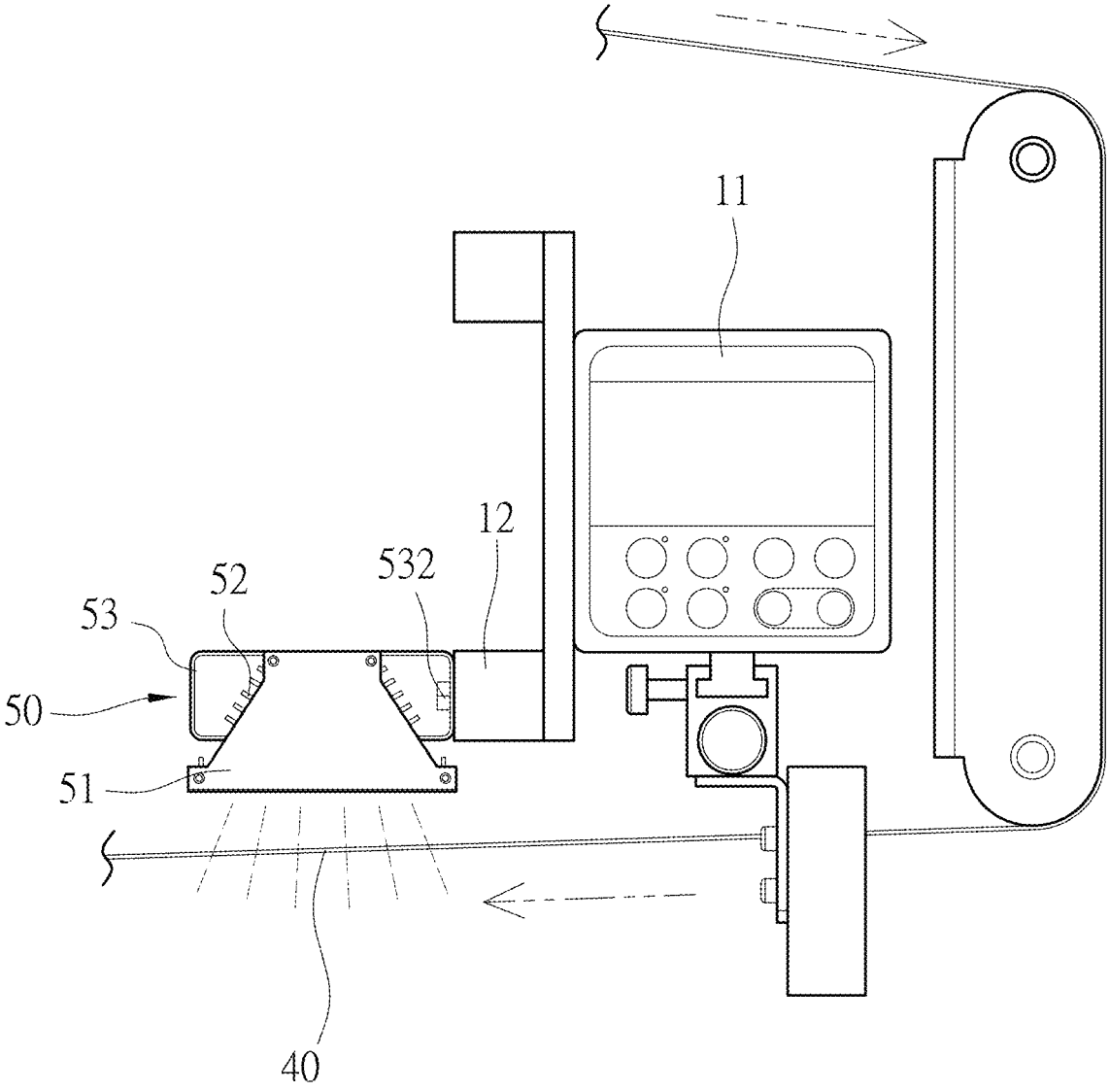
FIG. 5 is a side view of the paper towel roll being sterilized according to the preferred embodiment of the present invention.

First, please refer to FIG. 1. A packaging machine structure for wet paper towels having a sterilizing functionality comprising: at least one rolling unit 10, a cutting unit 20 attached behind the rolling unit 10, and a packing unit 30 attached behind the cutting unit 20. A plurality of wet paper towels 40 passes through the rolling unit 10, the cutting unit 20, and the packing unit 30 to become a plurality of wet paper towel packs 41. Furthermore, at least one germicidal lamp 50 is disposed between the rolling unit 10 and the cutting unit 20 to sterilize the wet paper towels 40. The germicidal lamps 50 are utilized to sterilize the wet paper towel 40 to ensure that the wet paper towel 40 has been fully sterilized before packaging, which helps to improve the hygiene of the wet paper towel 40.

Please refer to FIGS. 1-5, the rolling unit 10 at least one correction machine 11, two assembly brackets 12 disposed at an exit end of the correction machine and respectively disposed at an upper end and a lower end of the correction machine 11. Furthermore, the at least one germicidal lamp 50 is mounted on one of the assembly brackets 12, each assembly bracket 12 further comprises a track 121 with a plurality of screw nuts 13. Moreover, the germicidal lamp 50 further comprises a lamp holder 51, a plurality of cooling fans 52 and a lamp stand 53. The lamp holder 51 comprises at least one 40 W germicidal light bulb (not shown), and the cooling fans 52 are arranged around the lamp holder 51. The lamp stand 53 is mounted above the lamp holder 51, at least two through apertures 531 are disposed adjacent to the lamp stand 53 and paired with at least two bolts 532, and each bolt 532 is placed through the through aperture 531 and locked with the screw nut 13 of the assembly bracket 12, in order to secure the at least one germicidal lamp 50 onto the assembly bracket 12 of the correction machine 10, so that the at least one germicidal lamp 50 is moveably locked onto the track 121. Accordingly, the germicidal lamps 50 are mounted on the assembly bracket 12 of the correction machine 11 and face the exiting end. When the wet paper towel 40 is sent through the correction machine 11, it is irradiated by the germicidal lamps 50 for the purpose of sterilization during the rolling process. When the rolling unit 10 is provided with a plurality of the correction machines 11, and each of the correction machines 11 is provided with two assembly brackets 12 and equipped with one germicidal lamp. 50, which really achieves the sterilization effect of the wet paper towel 40 during the roll process.

Figure 6:
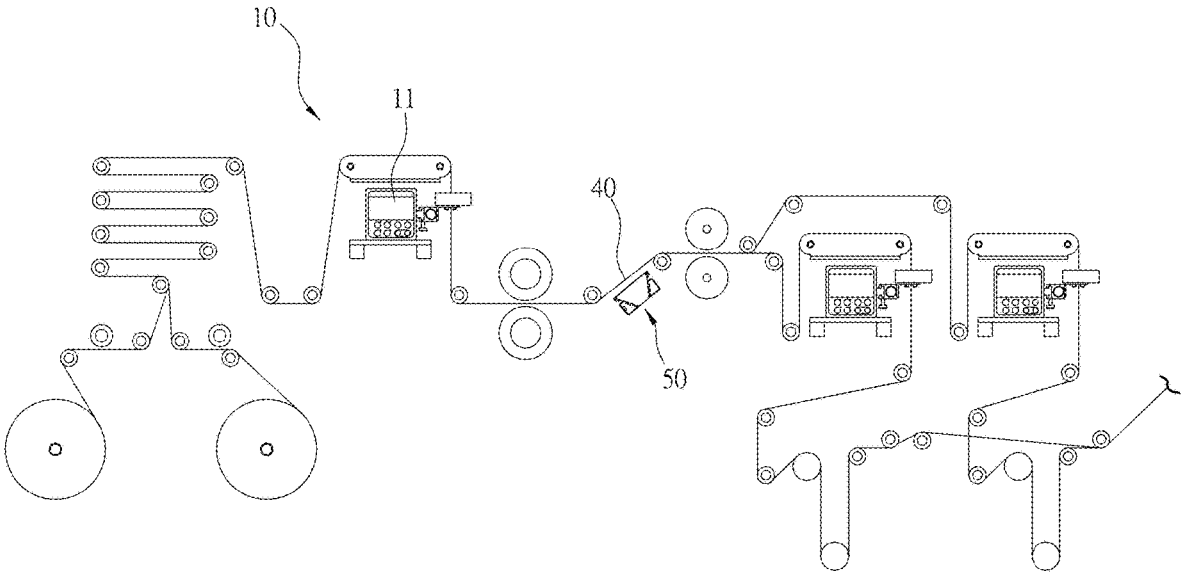
FIG. 6 is a schematic drawing of the germicidal lamp installed at any point during the rolling process according to the preferred embodiment of the present invention.
Figure 7:
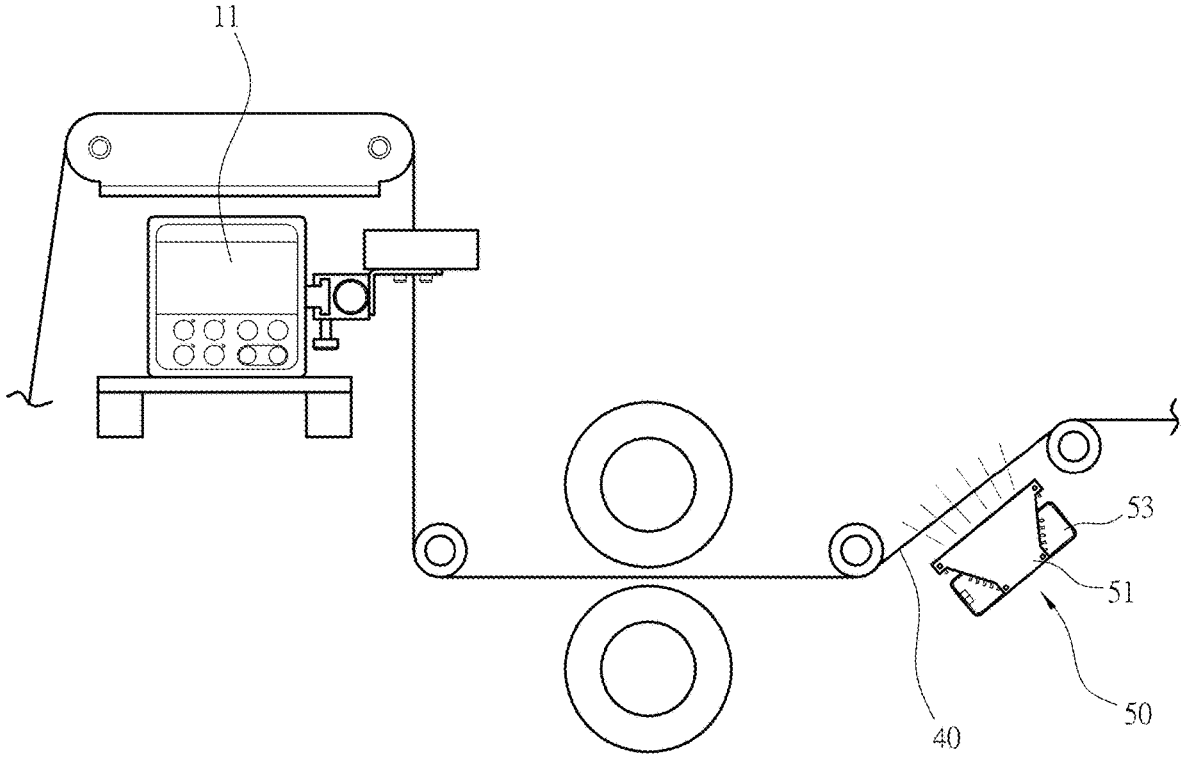
FIG. 7 is a partial enlarged drawing of the germicidal lamp installed at any point during the rolling process according to the preferred embodiment of the present invention.

As shown in FIGS. 6 and 7, the germicidal lamps 50 are installed at any position during the rolling process, between the two correction machines 11, and can achieve the sterilization effect during the wet paper towel 40 during the rolling process.

Through the structure of the above specific embodiment, the following benefits can be obtained: the present invention achieves the sterilization purpose of the wet paper towel 40 through at least one of the germicidal lamps 50 during the roll packaging process, so that the wet paper towel 40 can be fully sterilized before packaging to prevent bacteria, viruses or microorganisms from being brought into the package along with the wet paper towel 40, and to prevent the wet paper towel 40 from being contaminated. It also prevents the required addition of additives, bactericides and preservatives, thereby ensuring the quality, safety and reliability of the pure water wet paper towel, while reducing the chance of allergic reactions after using the wet paper towel 40, which improves the comfort of using the wet paper towel 40.

Although the present invention has been explained in relation to its preferred embodiment, it is to be understood that many other possible modifications and variations can be made without departing from the spirit and scope of invention as hereinafter claimed.

What is claimed is:

1. A packaging machine structure for wet paper towels having a sterilizing functionality, the packaging machine structure comprising:

at least one rolling unit, a cutting unit attached behind the at least one rolling unit, and a packing unit attached behind the cutting unit;

wherein:

the at least one rolling unit, the cutting unit, and the packing unit are configured so that a plurality of wet paper towels passing through the at least one rolling unit, the cutting unit, and the packing unit become a plurality of wet paper towel packs;

at least one germicidal lamp is disposed between the at least one rolling unit and the cutting unit to sterilize the wet paper towels;

the at least one rolling unit comprises at least one correction machine, two assembly brackets being disposed at an exit end of the at least one correction machine and being respectively disposed at an upper end and a lower end of the at least one correction machine;

the at least one germicidal lamp is mounted on at least one of the assembly brackets, each assembly bracket further comprising a track with a plurality of screw nuts; and the at least one germicidal lamp is moveably locked onto the track of the at least one of the assembly brackets via a plurality of bolts and the screw nuts on the track of the at least one of the assembly brackets.

2. The packaging machine structure as claimed in claim 1, wherein:

the at least one germicidal lamp further comprises a lamp holder, a plurality of cooling fans, and a lamp stand;

the lamp holder comprises at least one germicidal light bulb, and the cooling fans are arranged around the lamp holder;

the lamp stand is mounted above the lamp holder, and at least two through apertures are disposed adjacent to the lamp stand; and each bolt is respectively placed through one of the at least two through apertures and locked with one of the screw nuts of the at least one of the assembly brackets, in order to secure the at least one germicidal lamp onto the at least one of the assembly brackets.

3. The packaging machine structure claimed in claim 2, wherein the at least one germicidal light bulb of the at least one germicidal lamp is a 40 W light bulb.

* * * * *